US007307244B2

(12) United States Patent
Hansen et al.

(10) Patent No.: US 7,307,244 B2
(45) Date of Patent: Dec. 11, 2007

(54) SYSTEM AND METHOD FOR SUPPLYING WATER TO AN OVEN

(75) Inventors: William J. Hansen, Pewaukee, WI (US); Janus W. Bartelick, Germantown, WI (US)

(73) Assignee: Alto-Shaam, Inc., Menomonee Falls, WI (US)

( * ) Notice: Subject to any disclaimer, the term of this patent is extended or adjusted under 35 U.S.C. 154(b) by 0 days.

(21) Appl. No.: 11/356,541

(22) Filed: Feb. 17, 2006

(65) Prior Publication Data

US 2007/0194003 A1 Aug. 23, 2007

(51) Int. Cl.
*A21B 1/24* (2006.01)
*A21B 1/26* (2006.01)

(52) U.S. Cl. ..... 219/401; 126/20

(58) Field of Classification Search ..... None
See application file for complete search history.

(56) References Cited

U.S. PATENT DOCUMENTS

| | | | | |
|---|---|---|---|---|
| 5,517,980 | A * | 5/1996 | Cappello et al. | 126/20 |
| 6,995,341 | B2 * | 2/2006 | Riefenstein et al. | 219/401 |
| 2002/0036196 | A1 * | 3/2002 | Kohlstrung | 219/401 |
| 2004/0261632 | A1 * | 12/2004 | Hansen et al. | 99/468 |

* cited by examiner

*Primary Examiner*—J. Pelham
(74) *Attorney, Agent, or Firm*—Quarles & Brady LLP

(57) ABSTRACT

An oven includes a housing forming a cooking compartment defining an interior of the oven. A water supply line extends through the housing to position an end behind a fan within the cooking compartment. The fan is arranged within the cooking compartment near the water supply line to create a low pressure area about the end of the water supply line to draw water through the water supply line and into the fan.

19 Claims, 2 Drawing Sheets

SYSTEM AND METHOD FOR SUPPLYING WATER TO AN OVEN

CROSS REFERENCE TO RELATED APPLICATIONS

STATEMENT REGARDING FEDERALLY SPONSORED RESEARCH OR DEVELOPMENT

BACKGROUND OF THE INVENTION

The present invention relates generally to ovens using moving air and/or steam to cook food and, more particularly, to a system and method for handling water in combination ovens.

Many ovens include the ability to cook food using steam. For example, combination ovens provide the ability to cook foods using steam, hot-air convection, or both steam and convection. This combination of convection heating with steam provides a system where food can be properly cooked significantly faster than with traditional ovens or even convection ovens alone. As a result, combination ovens have become a vital asset in commercial cooking environments that need to cook food quickly and, often, in large quantities.

Combination ovens employ a motor driven fan to circulate air within a cooking chamber past electrical heating elements or gas heat exchange tubes to perform the convection functionality. To produce steam within the cooking chamber, a pressurized water line injects water into the cooking chamber, for example onto a rotating cup at the center of the fan, near the heating elements to disperse and vaporize the water. A system of this type is described in U.S. Pat. No. 6,188,045 issued Feb. 13, 2001, entitled: "Combination Oven With Three-Stage Water Atomizer", assigned to the assignee of the present invention and hereby incorporated by reference. In this regard, combination ovens require access to both electricity and pressurized water supply lines, such as municipal water supply lines.

Internal plumbing within the combination oven receives pressurized water from the plumbing of the kitchen and delivers it into the cooking chamber of the combination oven. As such, the internal plumbing is subjected to at least a portion of the heat generated within the cooking chamber. While modem plumbing techniques are designed to withstand variations in temperatures, the internal plumbing of combination ovens must be able to tolerate a temperature range extending from room temperature to several hundred degrees Fahrenheit (F). Furthermore, the internal plumbing must be able to tolerate this entire temperature range simultaneously during cooking periods because the plumbing fixtures arranged to interface with the kitchen plumbing are surrounded by room temperature conditions, while plumbing fixtures extending into the cooking compartment are surrounded by several hundred degree steam.

As such, a substantial cost of producing a combination oven is incurred in creating an internal plumbing system that is suited to these operating conditions. For example, considerable engineering design and manufacturing expertise is utilized to create internal plumbing systems for combination ovens that have a minimal number of joints and seals because such interfaces are negatively impacted by wide temperature variations.

Additionally, when including or incorporating a combination oven into a kitchen, the cost of purchasing the combination oven as well as the cost of providing the resources necessary to operating the combination oven (i.e. electricity and pressurized water connections) must be considered. In some cases, the cost of these resources may significantly impact the decision to include a combination oven within a kitchen.

The cost and complexity of installing a combination oven is at least one reason that combination ovens have only been widely adopted in large commercial kitchens and have not gained significant adoption in smaller commercial kitchens and consumer or home kitchens. In particular, it is widely recognized that plumbing costs account for a substantial amount of kitchen building expenses. This is generally true in both new construction, but can be particularly true when remodeling. As such, the decision to incorporate a combination oven into a kitchen, particularly a previously completed kitchen, may be relatively costly and outside of the budget for small commercial and/or residential kitchens.

Accordingly, it would be desirable to have a system and method to reduce the costs associated with ovens employing steam and, in particular, plumbing costs associated with such ovens. More specifically, it would be desirable to have a system and method for reducing the manufacturing costs associated with internal plumbing systems of ovens employing steam as well as for reducing the installation plumbing costs associated with incorporating such an oven into a kitchen.

SUMMARY OF THE INVENTION

The present invention overcomes the aforementioned drawbacks by providing a system and method for providing an oven with water without the need for extensive internal plumbing or pressurized water supplies. Specifically, the present invention includes a passive water supply system that is caused to draw water from an external reservoir in response to a low pressure area created by rotation of a fan within a cooking chamber of the oven. In this regard, the fan creates the force necessary to draw water into the oven, atomizes the water by drawing it into the rotating blades of the fan, and circulates the atomized water along with the air in the cooking compartment.

In accordance with one aspect of the invention, an oven is disclosed that includes a housing defining an interior cooking compartment for holding food at an elevated temperature. A fan is positioned adjacent to a wall of the housing to circulate air and water within the cooking compartment during a cooking process. Additionally, the fan provides an air flow region between the fan and the wall. A water supply line extends from an exterior of the housing through the wall at a point behind the fan to deliver water to the air flow region between the fan and the wall to be dispersed by the fan before passing into the cooking compartment. Accordingly, the water supply line length in the cooking compartment may be minimized.

In accordance with another aspect of the invention, an oven is disclosed that includes a housing forming a cooking compartment defining an interior of the oven. A water supply line extends through the housing to position an end of the water supply line within the cooking compartment. A fan is arranged within the cooking compartment near the end of the water supply line to create a low pressure area at the end of the water supply line to draw water into the cooking compartment from an external reservoir.

In accordance with yet another aspect of the invention, a method of operating an oven is disclosed that includes energizing a heating element configured to heat an enclosed cooking compartment of the oven. The method also includes rotating a fan to circulate air within the cooking compartment. Accordingly, a low pressure area is created that surrounds a water supply passage extending from a reservoir of water into the cooking compartment and that draws the water through the water supply passage into the cooking compartment to generate steam from the water.

Various other features of the present invention will be made apparent from the following detailed description and the drawings.

DETAILED DESCRIPTION OF THE INVENTION

Figure 1:
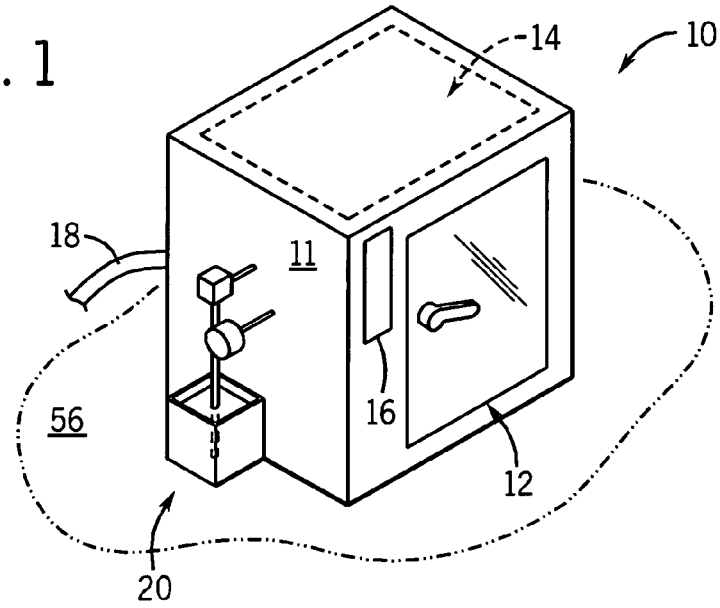
FIG. 1 is a perspective view of an oven having a water supply system in accordance with the present invention.

Referring now to FIG. 1, an oven 10, for example, a combination oven, includes a housing 11 having an oven door 12 that provides access into an inner cooking compartment 14 created within an interior of the housing 11. The oven 10 also includes a user interface 16 through which desired operational parameters or cooking processes may be entered by a user, an electrical connection 18 to provide electricity to the oven 10, and, as will be described, a water supply system 20 through which water is delivered to the oven 10 in order to generate the steam necessary to effectuate a combination convection cooking and steam cooking process.

In operation, a user places food within the cooking compartment 14 via oven door 12 and enters the desired cooking parameters through the user interface 16. Responsive thereto, electricity is drawn from the electrical connection 18 and water is drawn from the water supply system 20 to generate the heat and steam necessary to carry out the desired cooking process.

Figure 2:
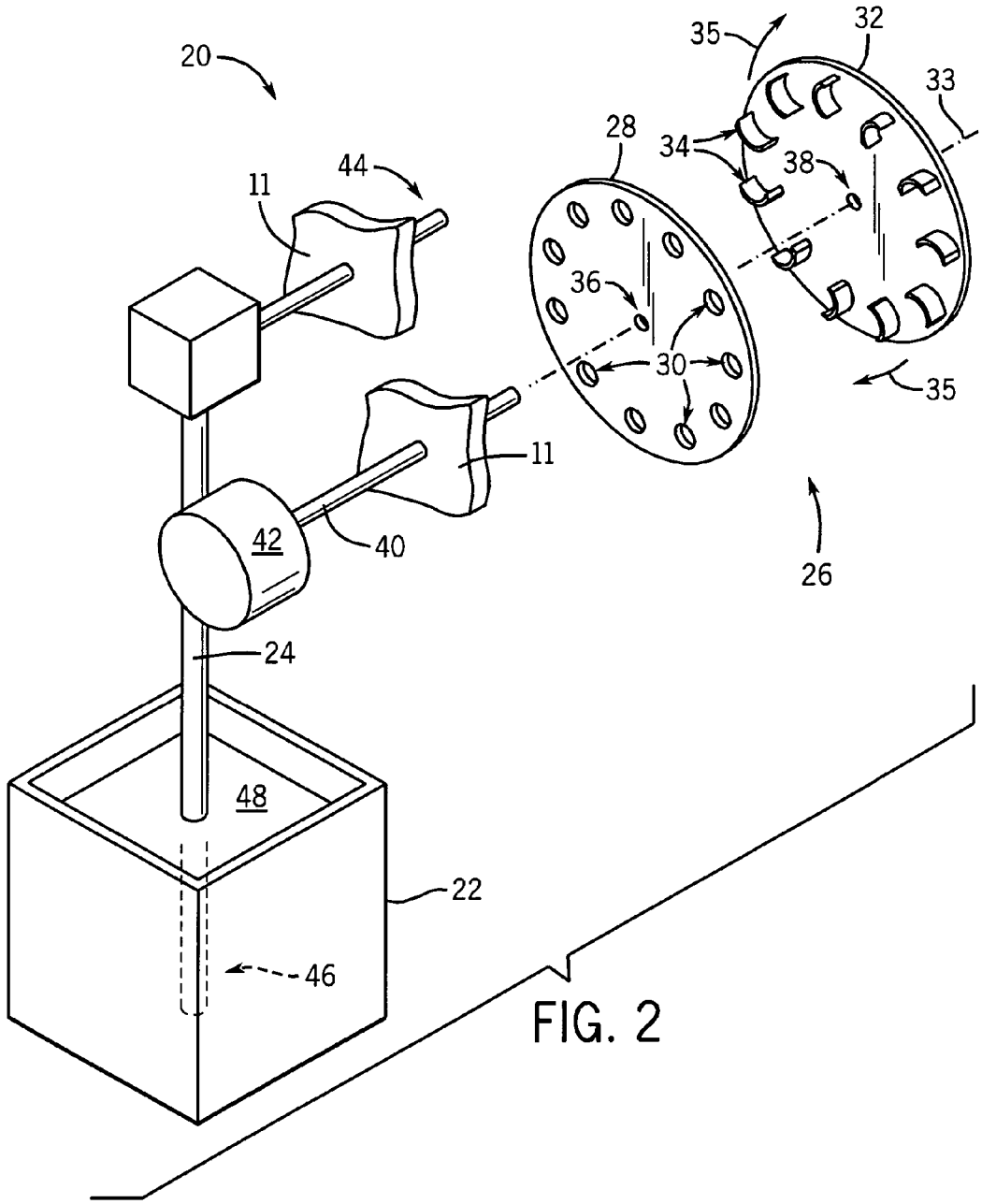
FIG. 2 is a perspective, partially exploded view of the water supply system of FIG. 1.

Referring now to FIG. 2, the water supply system 20 generally includes a reservoir 22, a water supply line 24, and a fan 26. The fan 26 includes a first circular plate 28 having a plurality of circumferentially spaced holes 30 formed along its periphery and a second parallel circular plate 32 of equal dimension spaced from the first plate 28 along a common rotational axis 33. A plurality of cupped blades 34 extends between the plates 28 and 32, joining the plates 28 and 32 at their peripheries just outside the holes 30. As the fan 26 rotates about the axis 33, the cupped blades 34 move with their concave faces forward to create a radially outward flow of air 35.

The plates 28, 32 also include central holes 36, 38 designed to be coaxially aligned along the axis 33 to receive a drive shaft 40 connected to a motor 42. In this regard, the motor 42 can rotate the drive shaft 40 to thereby rotate the fan 26.

The motor 42 is positioned outside the housing 11 with only the drive shaft 40 passing through a vertical wall of the housing 11 protecting the motor from high temperatures within the cooking compartment 14. According to one embodiment, the fan 26 is positioned within a few inches of the wall 11.

When the fan 26 is mounted on the drive shaft 40, a first end 44 of the water supply line 24 may pass through the wall of the housing 11 behind the fan 26 so that the first end 44 of the water supply line 24 is located proximate to the first plate 28 of the fan 26 having the plurality of holes 30 formed therein. In this way, only a short length of the water supply line 24 needs to extend into the cooking compartment 14 and no pipe fitting such as elbows and the like are positioned within the cooking compartment 14. It is contemplated that the first end 44 of the water supply line 24 may be near and generally parallel to the motor drive shaft 40. A second end 46 of the water supply line 24 is submerged in a supply of water 48 held in the reservoir 22.

Figure 3:
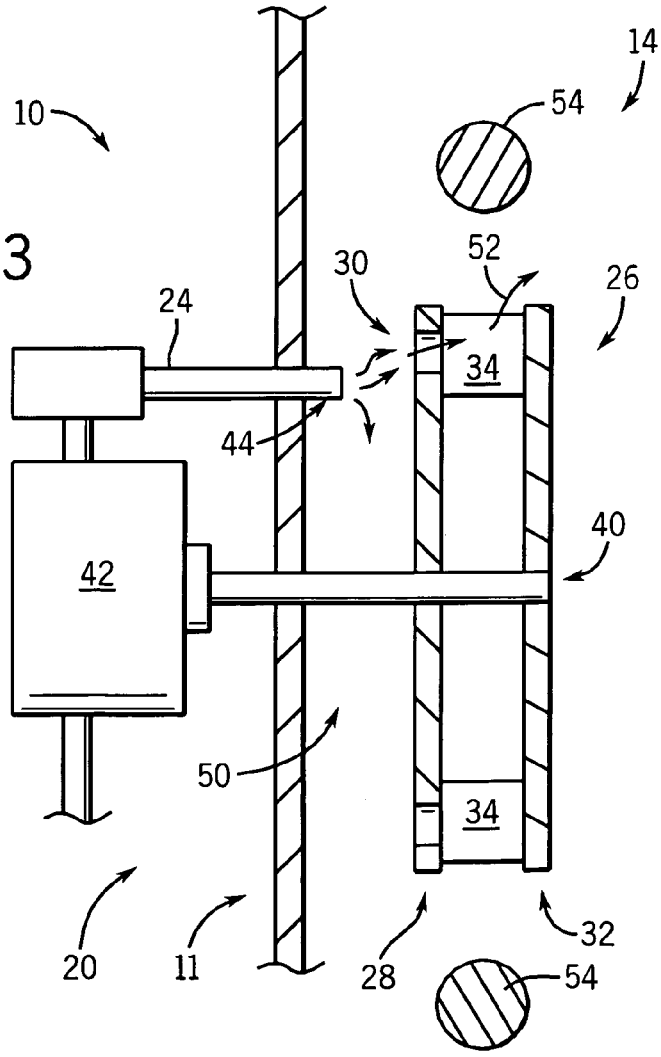
FIG. 3 is vertical cross-sectional view of the water supply system as assembled and engaged with the housing of the oven of FIG. 1.

Referring now to FIG. 3, when the water supply system 20 is assembled, such that the first end 44 of the water supply line 24 extends from the exterior through the housing 11 of the oven 10 and into the cooking compartment 14, the fan 26 is positioned on the drive shaft 40 and within the housing 11 of the oven 10. As such, when the fan 26 is rotated during a cooking process, air is drawn by the blades 34 radially along the wall and away from the housing 11, which creates a low pressure area 50 between the fan 26 and the housing 11 of the oven 10. As previously described, the first end 44 of the water supply line is arranged proximate to the first plate 28 of the fan 26 and, as such, is arranged within the low pressure area 50 between the fan 26 and the housing 11 of the oven 10.

Referring now to FIGS. 2 and 3, when the first end 44 of the water supply line 24 is subjected to the low pressure area 50, water 48 is drawn from the reservoir 22 through the second end 46 of the water supply line toward the first end 44 of the water supply line 44. In this regard, water is pulled from the reservoir 22 into the cooking compartment 14 of the oven 10 by the low pressure area 50. Furthermore, water is pulled by the fan 26 through the holes 30 formed in the first plate 28. The water impinges upon the blades 34 extending from the second plate 32, is atomized due to this contact, and is circulated into a convection flow as generally indicated by path 52. When entering the convection flow 52, the atomized water is subjected to the heat generated by a heating element 54 that substantially encircles the fan 26. In this regard, the atomized water is quickly vaporized and heated to the desired steam temperature.

Therefore, a system and method for delivering water into a oven is provided without the need for plumbing connections to pressurized water supplies, such as municipal water supplies. Furthermore, by arranging the convection fan 26 of the oven 10 within close proximity of a wall 11 of the cooking chamber 14 and arranging one end 44 of the water supply line 24 within that wall 11 near the fan 26, a low pressure area 50 can be created that will be capable of drawing water from the external reservoir 22 into the cooking compartment 14.

Therefore, the above-described system and method advantageously removes the need for connections to pressurized water sources. However, it is contemplated that a pump, though not required, may be included to draw the water from a remotely located reservoir and deliver the water to a position adequate to then be drawn by the low pressure area into the cooking compartment of the oven, for example a combination oven.

By removing the need for connections to pressurized water sources, the internal plumbing systems required for receiving pressurized water and delivering it into the cooking compartment is advantageously removed and manufacturing costs are reduced. Furthermore, by utilizing a significantly simplified and cost effective water supply system, a combination oven can be created that is easily incorporated into a kitchen. That is, referring again to FIG. 1, the oven 10 may be easily incorporated into a kitchen area without plumbing connections. In this regard, the oven 10 may be easily retrofitted into a kitchen and may even be advantageously located on a countertop 56 or other work surface because special accommodations for the oven 10 need not be made.

Therefore, a system and method is provided for supplying water to an oven without the need for pressurized water supply lines and associated plumbing systems. Rather, a passive water supply system is used that draws water from an external reservoir in response to the creation of a low pressure area within a cooking chamber of the oven generated by rotation of a fan. In this regard, the fan creates the force necessary to draw water into the oven, atomizes the water by drawing it into the rotating blades of the fan, and circulates the atomized water along with the air in the cooking compartment. Hence, a highly efficient and cost effective combination oven can be created.

It is specifically intended that the present invention not be limited to the embodiments and illustrations contained herein, but include modified forms of those embodiments including portions of the embodiments and combinations of elements of different embodiments as come within the scope of the following claims.

We claim:

1. An oven comprising:

a housing defining an interior cooking compartment for holding food at an elevated temperature;

a fan positioned adjacent to a wall of the housing to circulate air and water within the cooking compartment during a cooking process, the fan providing an air flow region between the fan and the wall;

a water supply line extending from an exterior of the housing through the wall at a point behind the fan to deliver water to the air flow region between the fan and the wall to be dispersed by the fan before passing into the cooking compartment;

an unpressurized reservoir of water in fluid communication with the water supply line; and wherein the fan creates a low pressure area in the air flow region that causes the water supply line to draw water from the unpressurized reservoir into the interior cooking compartment.

2. The oven of claim 1 further comprising a motor external to the cooking compartment having a drive shaft extending through the wall to support the fan.

3. The oven of claim 2 wherein the air flow region is an area of radial air flow about the drive shaft between the fan and the wall.

4. The oven of claim 1 wherein the fan creates a low pressure area in the air flow region with respect to air pressure outside the housing.

5. The oven of claim 1 wherein the fan comprises:

a first element providing a dispersing surface receiving and dispersing water from the water supply line; and a second element providing a plurality of blades to establish an airflow.

6. The oven of claim 5 wherein the first element is a plate parallel to the wall having the blades attached thereto and extending away from the wall and, wherein the plate further includes a plurality of holes allowing passage of water through the plate to be further dispersed by the blades.

7. The oven of claim 1 further comprising a heating element disposed within the cooking compartment and arranged proximate to and substantially encircling the fan to vaporize water drawn into the cooking compartment by the fan.

8. The oven of claim 1 wherein the oven is a combination oven.

9. An oven comprising:

a housing forming a cooking compartment defining an interior of the oven;

an reservoir of liquid arranged externally from the cooking compartment; and proximate to the housing;

a water supply line having a first end in communication with the reservoir and extending above the first end, through the housing, and to a second end arranged within the cooking compartment; and a fan arranged within the cooking compartment near the second end of the water supply line to create a low pressure area between the housing and the fan and about the second end of the water supply line to draw water into the cooking compartment from the reservoir.

10. The oven of claim 9 wherein the fan is further configured to atomize the water and circulate air and the atomized water within the cooking compartment during a cooking process.

11. The oven of claim 10 further comprising a heating element configured to heat the atomized water to create steam within the cooking compartment.

12. The oven of claim 11 wherein the heating element is configured to substantially encircle the fan.

13. The oven of claim 9 wherein the low pressure area is an area of radial air flow between the fan and the housing.

14. The oven of claim 9 wherein the fan comprises:

a first element providing a dispersing surface receiving and dispersing water from the water supply line; and a second element providing a plurality of blades to establish an airflow.

15. The oven of claim 14 wherein the first element is a plate parallel to a wall of the housing having the blades attached thereto and extending away from the wall and, wherein the plate further includes a plurality of holes allowing passage of water through the plate to be further dispersed by the blades.

16. The oven of claim 9 wherein the oven is a combination oven.

17. The oven of claim 9 wherein the reservoir is unpressurized.

18. A method of operating an oven comprising:

energizing a heating element configured to heat an enclosed cooking compartment of the oven;

rotating a fan to circulate air within the cooking compartment and create a low pressure area surrounding a water supply passage that extends from an unpressurized reservoir of water located below the fan and into the cooking compartment;

wherein the low pressure area is sufficient to draw the water up from the unpressurized reservoir of water through the water supply passage and into the cooking compartment to generate steam from the water.

19. The method of claim 18 further comprising atomizing the water drawn into the cooking compartment by drawing it into the rotating fan and vaporizing the atomized water by subjecting the atomized water to the energized heating element to generate the steam.

* * * * *